US007963229B2

(12) United States Patent
Timan

(10) Patent No.: US 7,963,229 B2
(45) Date of Patent: Jun. 21, 2011

(54) MONORAIL BOGIE ASSEMBLY COMPRISING A LINKING MEMBER

(75) Inventor: Peter Edward Timan, Sydenham (CA)

(73) Assignee: Bombardier Transportation GmbH, Berlin (DE)

( * ) Notice: Subject to any disclaimer, the term of this patent is extended or adjusted under 35 U.S.C. 154(b) by 396 days.

(21) Appl. No.: 12/129,222

(22) Filed: May 29, 2008

(65) Prior Publication Data

US 2009/0293758 A1 Dec. 3, 2009

(51) Int. Cl.
*B61B 13/00* (2006.01)

(52) U.S. Cl. ..... 105/141; 105/147; 105/144; 104/118; 104/119; 104/121

(58) Field of Classification Search ..... 104/124, 104/126, 125, 118, 119, 121; 105/3, 4.1, 105/4.2, 4.3, 4.4, 165, 167, 141, 144, 147
See application file for complete search history.

(56) References Cited

U.S. PATENT DOCUMENTS

| | | | |
|---|---|---|---|
| 3,017,838 | A | 1/1962 | Bingham |
| 3,143,977 | A | 8/1964 | Deller |
| 3,216,371 | A | 11/1965 | Holmquist et al. |
| 3,584,583 | A | 6/1971 | Cartwright |
| 3,602,152 | A | 8/1971 | Hawes |
| 4,362,108 | A | 12/1982 | Jenkner |
| 4,485,743 | A | 12/1984 | Roush et al. |
| 4,825,774 | A | 5/1989 | Tani et al. |
| 4,843,971 | A | 7/1989 | Braunagel |
| 4,926,756 | A | 5/1990 | Smith et al. |
| 4,953,472 | A | 9/1990 | Tutzer |
| 6,523,481 | B2 | 2/2003 | Hara et al. |
| 2005/0241525 | A1 | 11/2005 | Coakley |

FOREIGN PATENT DOCUMENTS

| | | | |
|---|---|---|---|
| CA | 654092 | | 12/1962 |
| CA | 1327916 | | 3/1994 |
| CA | 2337977 | | 9/2001 |
| JP | 64-028066 | | 1/1989 |
| JP | 01-078967 | | 3/1989 |
| JP | 64-078967 | | 3/1989 |
| JP | 02-070804 | | 3/1990 |
| JP | 03-262713 | | 11/1991 |
| JP | 2000-071980 | | 3/2000 |
| JP | 2000-264198 | * | 9/2000 |
| JP | 2000264198 | | 9/2000 |
| WO | PCT/CA2009/000161 | | 5/2009 |
| WO | PCT/CA2009/000162 | | 5/2009 |
| WO | PCT/CA2009/00162 | | 5/2009 |
| WO | PCT/CA2009/001487 | | 7/2010 |

* cited by examiner

*Primary Examiner* — Mark T Le

(57) ABSTRACT

A monorail bogie assembly for supporting at least one monorail car over a monorail track that has a running surface and two side surfaces. The monorail bogie assembly comprises a first monorail bogie for supporting a first monorail car. The first monorail bogie comprises at least one load-bearing wheel, two inboard guide wheels and two outboard guide wheels. The monorail bogie assembly further comprises a second monorail bogie for supporting a second monorail car. The second monorail bogie comprises at least one load-bearing wheel and two inboard guide wheels. The monorail bogie assembly further comprises a linking member for interconnecting the first monorail bogie and the second monorail bogie, such that when connected the second monorail bogie is absent any outboard guide wheels.

16 Claims, 14 Drawing Sheets

MONORAIL BOGIE ASSEMBLY COMPRISING A LINKING MEMBER

FIELD OF THE INVENTION

The present invention relates to the field of railway bogies, and more specifically, to railway bogies, such as monorail bogies, that are interconnected together via a linking member.

BACKGROUND OF THE INVENTION

Monorail bogies for supporting monorail cars are known in the art, and are used in many monorail car assemblies. However, a common deficiency with monorail bogies is that they are expensive and do not allow adjacent monorail cars to be positioned close together. In addition, a common deficiency with monorail bogies is that as the bogies travel around curves in the track, load tire forces cause high bogie guide tire forces which results in skewed load wheel operation.

A desirable feature for many monorail and other conventional transit car assemblies is for adjacent cars to be positioned relatively close together so as to permit a walk-through space between the cars and in addition to minimize overall train length. Obviously, when the cars are positioned far apart, with a large space therebetween, the increased distance between cars makes it more difficult to safely design a walk through space. In addition, the larger space between cars results in a longer train which results in a longer station and increased station and land acquisition costs. A desirable feature for many transit car assemblies is to minimize bogie guide tire forces and to minimize load tire skew angles as this will minimize guide tire and load tire wear and maximize tire life.

In light of the above, it can be seen that there is a need in the industry for an improved monorail bogie that alleviates, at least in part, the deficiencies of the prior art, and improves on the overall functionality of existing monorail bogies.

SUMMARY OF THE INVENTION

In accordance with a first broad aspect, the present invention provides a monorail bogie assembly for supporting at least one monorail car over a monorail track that has a running surface and two side surfaces. The monorail bogie assembly comprises a first monorail bogie for supporting a first monorail car. The first monorail bogie comprises at least one load-bearing wheel for running along the running surface of the monorail track, two inboard guide wheels for running along respective ones of the two side surfaces of the monorail track and two outboard guide wheels for running along respective ones of the two side surfaces of the monorail track. The monorail bogie assembly further comprises a second monorail bogie for supporting a second monorail car. The second monorail bogie comprises at least one load-bearing wheel for running along the running surface of the monorail track and two inboard guide wheels for running along respective ones of the two side surfaces of the monorail track. The monorail bogie assembly further comprises a linking member for interconnecting the first monorail bogie and the second monorail bogie, such that when connected the second monorail bogie is absent any outboard guide wheels.

In accordance with a second broad aspect, the present invention provides a monorail bogie for supporting a monorail car over a monorail track that has a running surface and two side surfaces. The monorail bogie comprises a body portion having a longitudinal axis that is parallel to a direction of travel of the monorail bogie and a transverse axis that is perpendicular to the direction of travel of the monorail bogie. The body portion is divided into an inboard portion located on a first side of the transverse axis and an outboard portion located on a second side of the transverse axis. The monorail bogie further comprises at least one load-bearing wheel for running along the running surface of the monorail track, two guide wheels that are connected to the inboard portion of the body portion that are suitable for running along respective ones of the two side surfaces of the monorail track, and a connection portion on the outboard portion of the body portion for enabling the body portion to be connected, via a linking member, to another monorail bogie that supports a different monorail car, wherein when connected the monorail bogie is absent any outboard guide wheels.

In accordance with a third broad aspect, the present invention provides a monorail car assembly for supporting monorail cars over a monorail track that has a running surface and two side surfaces. The monorail car assembly comprises a first monorail car having a first monorail bogie and a second monorail car having a second monorail bogie. The first monorail bogie and the second monorail bogie are interconnected via a linking member, wherein the linking member includes a rod that is pivotally connected at a first end to the first monorail bogie and pivotally connected at a second end to the second monorail bogie. The rod comprises a longitudinal axis that is oriented substantially perpendicular to a direction of travel of the first and second monorail cars.

In accordance with a fourth broad aspect, the present invention provides a method for manufacturing a monorail bogie assembly. The method comprises providing a first monorail bogie for supporting a first monorail car over a monorail track that has a running surface and two side surfaces. The first monorail bogie comprises at least one load-bearing wheel for running along the running surface of the monorail track, two inboard guide wheels for running along respective ones of the two side surfaces of the monorail track and two outboard guide wheels for running along respective ones of the two side surfaces of the monorail track. The method further comprises providing a second monorail bogie for supporting a second monorail car over the monorail track. The second monorail bogie comprises at least one load-bearing wheel for running along the running surface of the monorail track and two inboard guide wheels for running along respective ones of the two side surfaces of the monorail track. The method further comprises interconnecting the first monorail bogie and the second monorail bogie together via a linking member, such that when connected the second monorail bogie is absent any outboard guide wheels.

In accordance with a fifth broad aspect, the present invention provides a method for manufacturing a monorail bogie. The method comprises providing a body portion of a monorail bogie for supporting a monorail car over a monorail track that has a running surface and two side surfaces. The body portion has a longitudinal axis that is parallel to a direction of travel of the monorail bogie, and a transverse axis that is perpendicular to the direction of travel of the monorail bogie. The body portion is divided into an inboard portion located on a first side of the transverse axis and an outboard portion located on a second side of the transverse axis. The method further comprises mounting to the body portion at least one load-bearing wheel for running along the running surface of the monorail track, mounting to the inboard portion of the body portion two guide wheels suitable for running along respective ones of the two side surfaces of the monorail track and mounting to the outboard portion of the body portion, a connection portion for enabling the body portion to be connected, via a linking member, to another monorail bogie that supports a different monorail car. When connected to another monorail bogie, the monorail bogie is absent any outboard guide wheels.

These and other aspects and features of the present invention will now become apparent to those of ordinary skill in the art upon review of the following description of specific embodiments of the invention and the accompanying drawings.

Other aspects and features of the present invention will become apparent to those ordinarily skilled in the art upon review of the following description of specific embodiments of the invention in conjunction with the accompanying figures.

DETAILED DESCRIPTION

Figure 1:
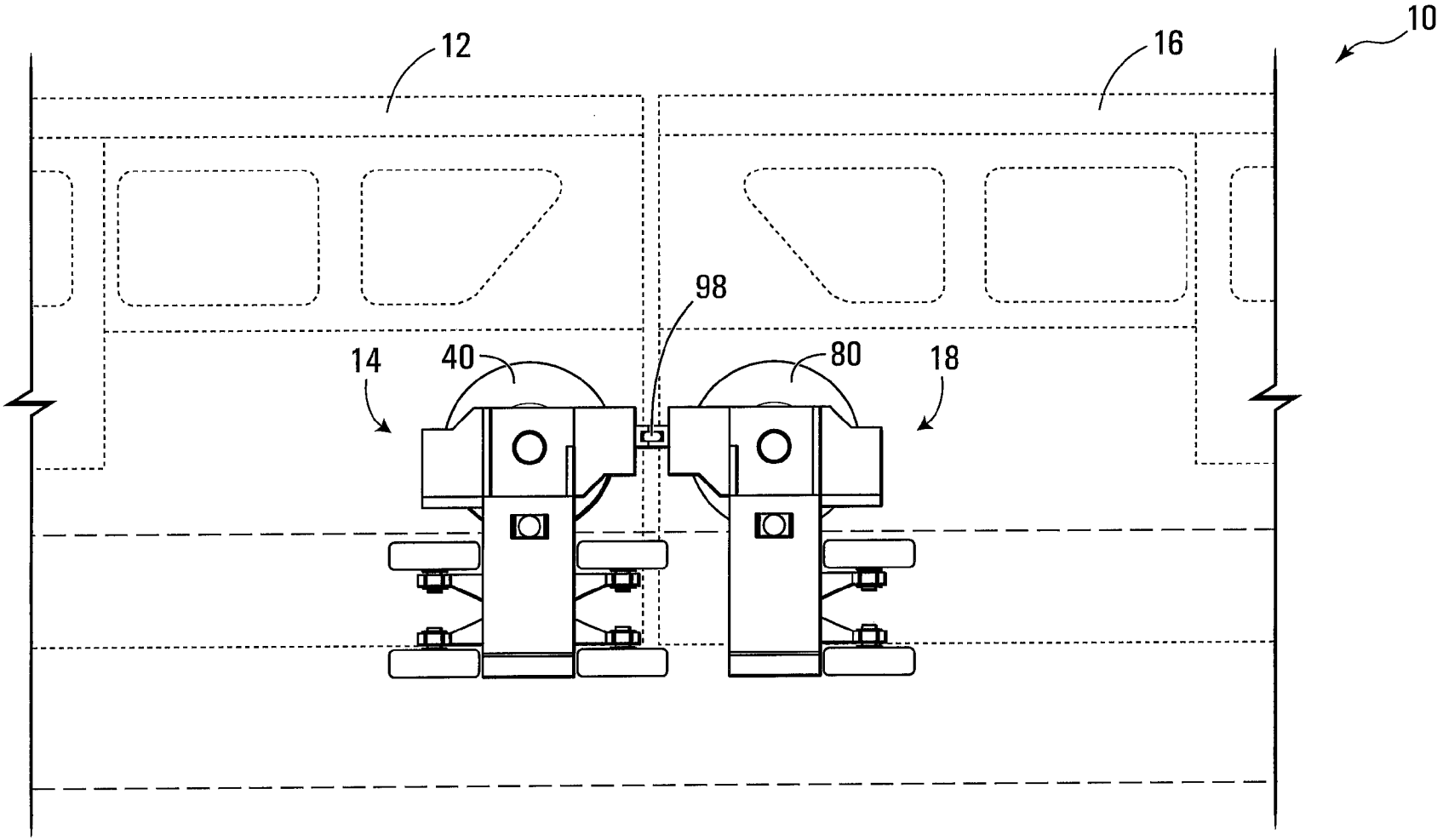
FIG. 1 shows a side view of first and second single-axle bogies in accordance with a non-limiting example of implementation of the present invention, with two monorail cars shown in dotted lines.

Turning now to the drawings, and referring first to FIG. 1, a non-limiting example of a monorail car assembly 10 that is suitable for travelling over a monorail track is illustrated. The monorail car assembly 10 comprises a first monorail car 12 having a first bogie 14, and a second monorail car 16 having a second bogie 18. As will be described in more detail below, and in accordance with the present invention, the first bogie 14 and the second bogie 18 are operative for being connected together via a linking member 98 such that the first bogie 14 acts as a master bogie and the second bogie 18 acts as a slave bogie. The linking member 98 permits the first monorail car 12 and the second monorail car 16 to be connected in close proximity to each other, so as to permit a walk-through space between monorail cars 12 and 16. The linking member 98 further permits shorter train length, which results in shorter stations and thus reduced capital and land acquisition costs.

For the purposes of the present invention, the first bogie 14 and the second bogie 18 will be described herein as being single-axle monorail bogies that are suitable for supporting the respective first and second monorail cars 12, 16 over a monorail track. It should, however, be appreciated that in an alternative embodiment, the first and second bogies 14 and 18 could be double-axle bogies, or multi-axle bogies, without departing from the spirit of the invention. In addition, it should be appreciated that the linking member 98 of the present invention could be applied to railway bogies that are not monorail bogies. Moreover, the linking member 98 could be used with any type of guided vehicle that has adjacent bogies.

In addition, although the first and second monorail cars 12, 16 shown in FIG. 1 are passenger cars for carrying people, it should be appreciated that in an alternative embodiment, the monorail cars 12, 16 could also be locomotive cars or cargo cars, without departing from the spirit of the invention. As such, the first and second bogies 14, 18 described herein can be used for passenger cars, locomotive cars, or cargo cars among other possibilities.

Shown in FIGS. 2 through 5 are expanded views of the first bogie 14 in accordance with a non-limiting embodiment of the present invention. The first bogie 14 includes four guide wheels, 42*a*, 42*b*, 44*a* and 44*b*, and as such will be referred to as the master bogie. As will be described further on in the description, the second bogie 18 includes only two guide wheels 82*a* and 82*b*, and as such will be referred to as the slave bogie.

For the purposes of clarity, the first bogie 14 is shown independently from the second bogie 18, and is shown without the monorail car 12 attached thereto. In addition, the first bogie 14 is shown positioned on a monorail track 20. The monorail track 20, along which both the first bogie 14 and the second bogie 18 are designed to travel, includes a substantially horizontal running surface 22 and two side surfaces 24. The monorail track 20 can be positioned along a ground-based guideway, or can be supported on elevated structures above the ground, such as in the case where the monorail cars are designed to be part of an elevated transit system, for example.

The first bogie 14 includes a body portion 26 having a first side portion 28 and a second side portion 30 that are joined together by a front-joining portion 32 and a rear-joining portion 34. When the first bogie 14 is positioned on the monorail track 20, the front-joining portion 32 and the rear-joining portion 34 extend over the running surface 22 of the monorail track 20. In addition, the first side portion 28 and the second side portion 30 of the first bogie 14 are positioned adjacent respective ones of the two side surfaces 24 of the monorail track 20. In the embodiment shown, the front-joining portion 32 and the rear-joining portion 34 are in the form of rectangular-shaped beams. It should, however, be appreciated that the front-joining portion 32 and the rear-joining portion 34 could be of any shape, size and configuration that is suitable for joining the first side portion 28 and the second side portion 30 of the first bogie 14 together.

It should be appreciated that the front-joining portion 32 is not necessarily required to be facing frontwardly, and the rear-joining portion 34 is not necessarily required to be facing rearwardly when the single-axle bogie 14 is attached to the monorail car 12. Instead, the front-joining portion 32 and the rear-joining portion 34 can be positioned in either direction of travel, such that the bogie 14 can move either forwardly or backwardly without changing its orientation on the railway track. In other words, the master bogie could be leading in the direction of travel, or the slave bogie could be leading in the direction of travel.

In the embodiment shown, the body portion 26 of the first bogie 14 is operative for supporting two load bearing wheels 40, two inboard guide wheels 42*a*, 42*b*, two outboard guide wheels 44*a*, 44*b* and four stabilizing wheels 46*a*, 46*b*, 46*c*, 46*d*.

Figure 5:
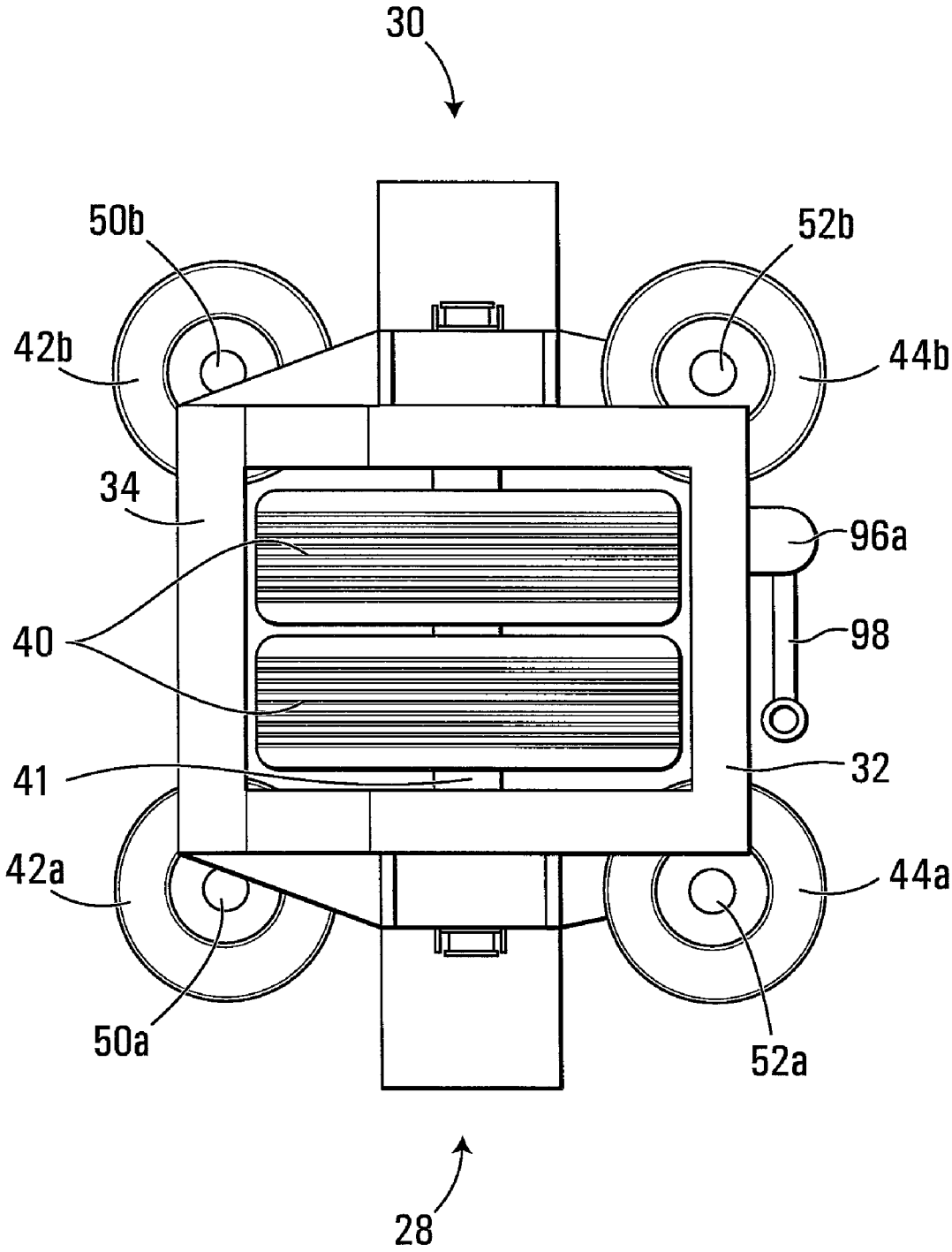
FIG. 5 shows a top view of the single-axle bogie of FIG. 2.
Figure 6:
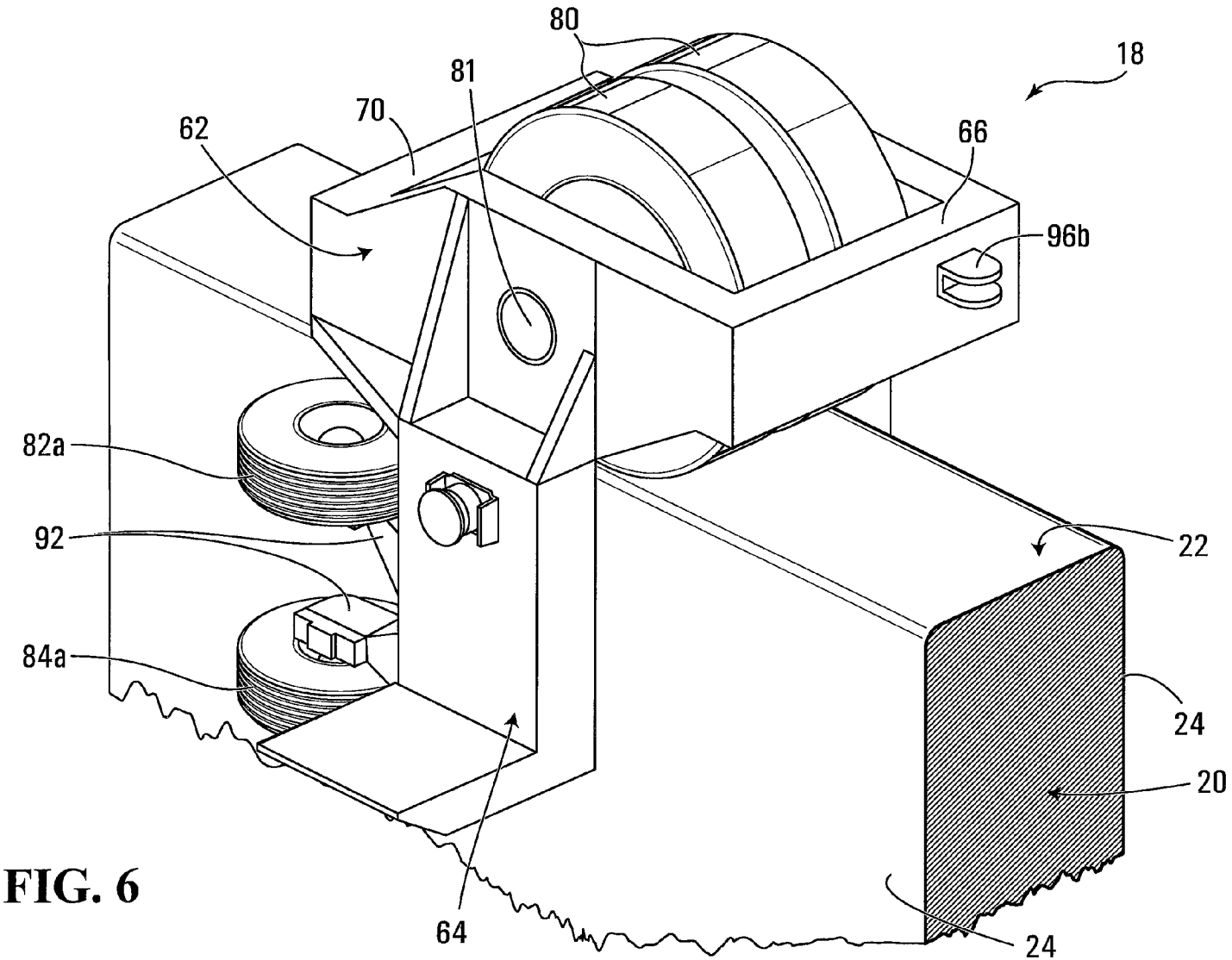
FIG. 6 shows a front perspective view of the second single-axle bogie of FIG. 1.

With reference to FIG. 5, it can be seen that the two load-bearing wheels 40 are positioned between the front joining portion 32 and the rear joining portion 34 and are operative for running along the horizontal running surface 22 of the monorail track 20. The axle 41 of the two load-bearing wheels 40 is supported on either side by the first side portion 28 and the second side portion 30 of the body portion 26 of the first bogie 14, such that the axis of rotation about which the two load-bearing wheels 40 rotate is parallel to the running surface 22 of the monorail track 20. Although in the embodiment shown, the first bogie 14 includes two load-bearing wheels 40, it should be appreciated that the first bogie 14 could also include only one, or three or more load-bearing wheels 40, without departing from the spirit of the invention. In addition, it should be appreciated that the axle 41 of the load bearing wheels 40 could be supported from only one of side portions 28 or 30 of the body portion 26, or by any other means known in the art.

The axle 41 of the load bearing wheels 40, is positioned perpendicular to the direction of travel of the monorail bogie 14, and divides the body portion 26 of the first bogie 14 into an inboard side and an outboard side. As used herein, the inboard side of the bogie 14 is the side that is in closer proximity to the centre of the monorail car 12, and the outboard side of the bogie 14 is the side that is in closer proximity to the end of the monorail car 12. The two inboard guide wheels 42*a* and 42*b* are positioned on the inboard side of the body portion 26 of the monorail bogie 14 and are operative for running along respective ones of the two side surfaces 24 of the monorail track 20. Likewise, the two outboard guide wheels 44*a* and 44*b* are located on the outboard side of the body portion 26 of the monorail bogie 14 and are operative for running along respective ones of the two side surfaces 24 of the monorail track 20. In an alternative embodiment, the bogie 14 does not include guide wheels 42*a*, 42*b*, 44*a*, 44*b*, and instead, can be guided by one central guide tire, or by other guidance means known in the art.

Figure 3:
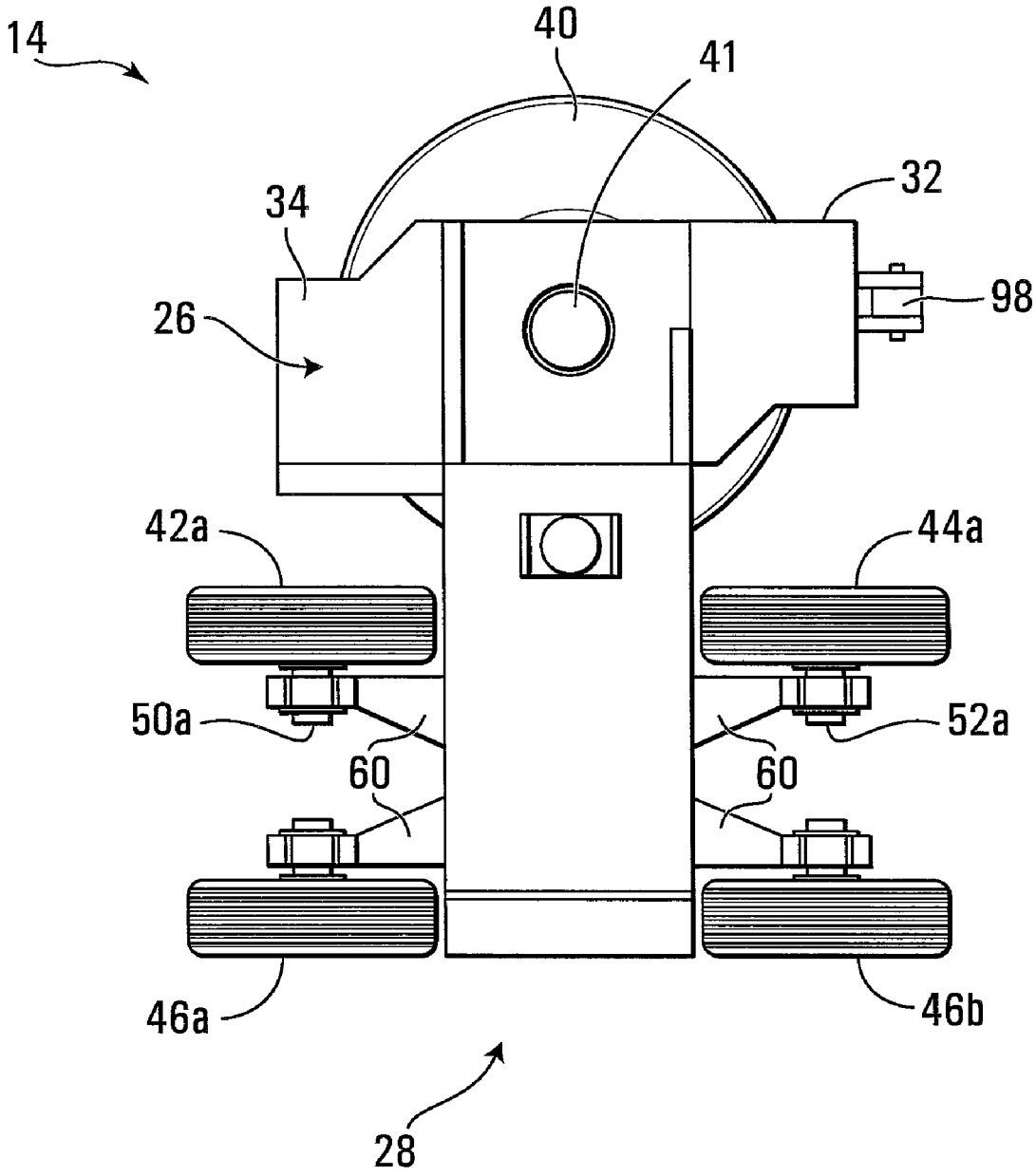
FIG. 3 shows a right side view of the single-axle bogie of FIG. 2.
Figure 4:
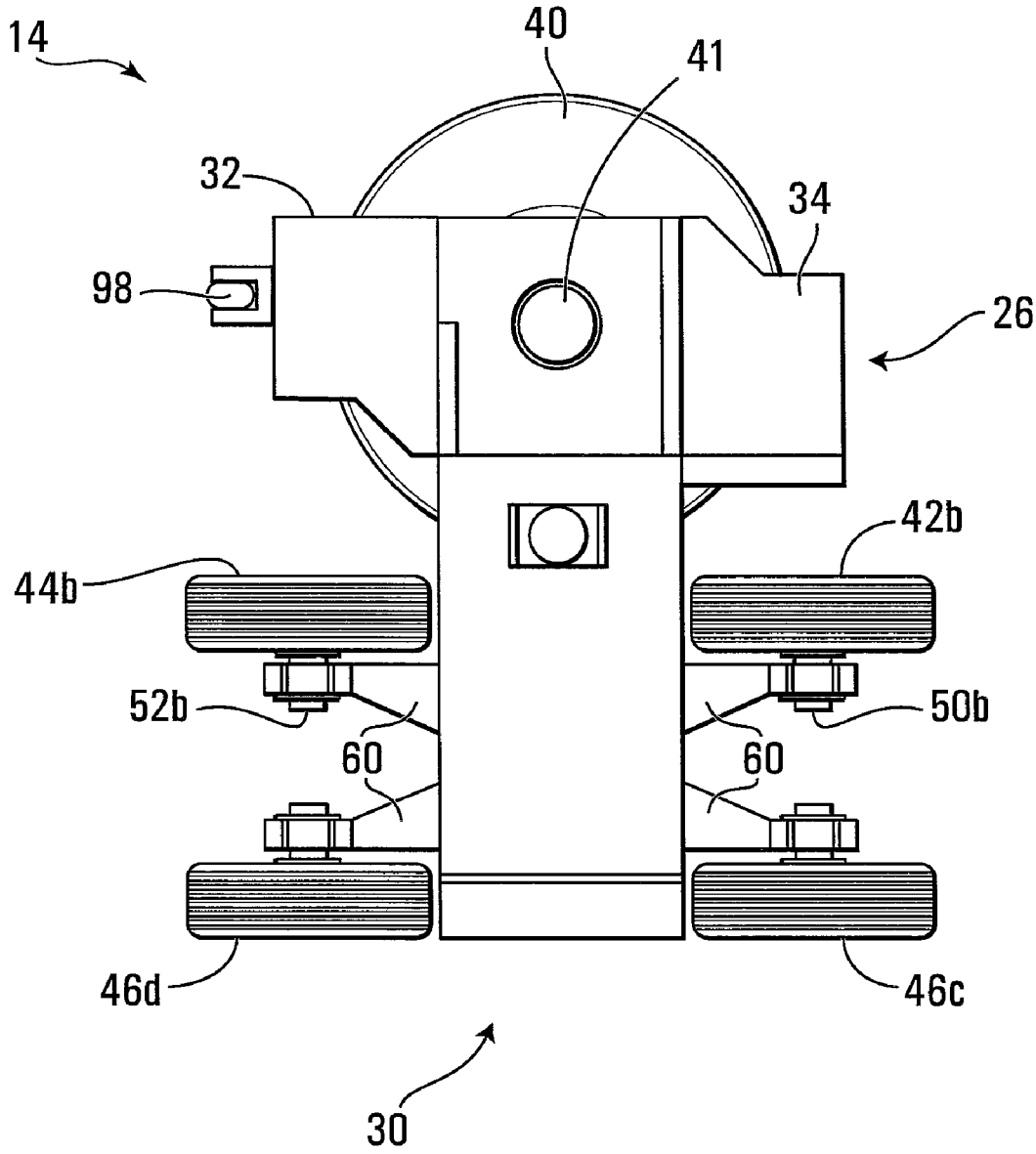
FIG. 4 shows a left side view of the single-axle bogie of FIG. 2.

As best shown in FIGS. 3 and 4, the inboard guide wheels 42*a* and 42*b* have axles 50*a* and 50*b* respectively, that have axes of rotation that are laterally offset to one side of the axis of rotation of the load bearing wheels 40. The outboard guide wheels 44*a* and 44*b* have axles 52*a* and 52*b* respectively, that have axes of rotation that are laterally offset to the opposite side of the axis of rotation of the load bearing wheels 40. All of the axles 50*a*, 50*b*, 52*a* and 52*b* are operative for being substantially parallel to the side surfaces 24 of the monorail track 20 when in operation.

In accordance with a non-limiting example of implementation, the axle 41 of the load-bearing wheels 40 is positioned centrally between the inboard guide wheels 42*a*, 42*b* and the outboard guide wheels 44*a*, 44*b*. In other words, the axle 41 is equidistant between the axles 50*a*, 52*a* and the axles 50*b*, 52*b*. In an alternative embodiment, the axle 41 of the load-bearing wheels 40 may not be equidistant between the axles of the inboard guide wheels 42*a*, 42*b* and the outboard guide wheels 44*a*, 44*b*, and instead may be located in closer proximity to either the inboard guide wheels 42*a*, 42*b* or to the outboard guide wheels 44*a*, 44*b*.

As best shown in FIGS. 3 and 4, positioned below both of the inboard guide wheels 42*a*, 42*b* and the outboard guide wheels 44*a*, 44*b* are stabilizing wheels 46*a*, 46*b*, 46*c*, 46*d*. The stabilizing wheels 46*a*, 46*b*, 46*c*, 46*d* have axles 54*a*, 54*b*, 54*c*, 54*d*, that are each co-axial with a respective axle of the guide wheels 42*a*, 42*b*, 44*a*, 44*b*. As indicated above, the stabilizing wheels 46*a*, 46*b*, 46*c*, 46*d* are positioned beneath respective guide wheels in the z-direction. In an alternative embodiment that is not shown, the stabilizing wheels 46*a*, 46*b*, 46*c*, 46*d* may not be co-axial to any of the guide wheels. In addition, there may not be required four stabilizing wheels, and instead, fewer stabilizing wheels could be used. In yet a further embodiment, no stabilizing wheels are required in the case where other means of providing roll stability is used (i.e. by providing dual load wheels spaced sufficiently far apart, etc). As such, it should be appreciated that the present invention is not limited to the manner in which each bogie achieves roll stabilization.

By positioning the stabilizing wheels 46*a*, 46*b*, 46*c*, 46*d* beneath the inboard guide wheels 42*a*, 42*b* and beneath the outboard guide wheels 44*a*, 44*b*, the stabilizing wheels 46*a*, 46*b*, 46*c*, 46*d* act to prevent the rolling of the first bogie 14 about the monorail track 20, which in turn reduces the rolling of the monorail car 12. More specifically, by having the stabilizing wheels 46*a*, 46*b*, 46*c*, 46*d* positioned beneath respective guide wheels, the axles 54*a*, 54*b*, 54*c*, 54*d* remain substantially parallel to the side surfaces 24 of the monorail track 20 during travel. As mentioned, above, roll stabilization can be provided in accordance with other means known in the art.

Although in the embodiment shown, the first bogie 14 has four stabilizing wheels 46*a*, 46*b*, 46*c*, 46*d*, in an alternative embodiment, the first bogie 14 may have only two stabilizing wheels. In such an embodiment, it is possible that the two stabilizing wheels could be positioned below the two inboard guide wheels 42*a*, 42*b*, or alternatively, the two stabilizing wheels could be positioned below the two outboard guide wheels 44*a*, 44*b*, or anywhere in between the inboard guide wheels and the outboard guide wheels.

As best show in FIGS. 3 and 4, the inboard guide wheels 42*a*, 42*b*, the outboard guide wheels 44*a*, 44*b* and the stabilizing wheels 46*a*, 46*b*, 46*c*, 46*d* are supported on the first bogie 14 via supporting arms 60. The supporting arms 60 have a flat surface adjacent to the wheel that is being supported, and an angled surface extending from the wheel to the body portion 26 of the first bogie 14. It should be appreciated that in an alternative embodiment, the supporting arms 60 could take on different shapes, without departing from the spirit of the invention. In addition, the inboard guide wheels 42*a*, 42*b*, the outboard guide wheels 44*a*, 44*b* and the stabilizing wheels 46*a*, 46*b*, 46*c*, 46*d* could be supported on the first bogie 14 in a variety of different manners other than supporting arms 60.

As will be described in more detail further on in the description, attached to the front joining portion 32 of the bogie 14 is a linking member 98 for connecting the first bogie 14 to the second bogie 18, as shown in FIG. 1. The linking member 98 is pivotally attached to the first bogie 14 at connection portion 96*a* (shown in FIG. 2).

Shown in FIGS. 6 through 9 are expanded views of the second bogie 18 in accordance with a non-limiting embodiment of the present invention. As indicated above, the second bogie 18 includes only two guide wheels 82*a* and 82*b*, and as such will be referred to as the slave bogie. For the purposes of clarity, the second bogie 18 is shown independently from the first bogie 14, and is shown without the second monorail car 16 attached thereto.

Similarly to the first bogie 14, the second bogie 18 includes a body portion 62 that has a first side portion 64 and a second side portion 68 that are joined together by a front-joining portion 66 and a rear-joining portion 70. When the second bogie 18 is positioned on the monorail track 20, the front-joining portion 66 and the rear-joining portion 70 extend over the running surface 22 of the monorail track 20. In addition, the first side portion 64 and the second side portion 68 of the second bogie 18 are positioned adjacent respective ones of the two side surfaces 24 of the monorail track 20. In the embodiment shown, the front-joining portion 66 and the rear-joining portion 70 are in the form of rectangular shaped beams. It should, however, be appreciated that the front-joining portion 66 and the rear-joining portion 70 could be of any shape, size and configuration that is suitable for joining the first side portion 64 and the second side portion 68 of the second bogie 18 together.

In addition, the front-joining portion 66 is not necessarily required to be facing frontwardly and the rear-joining portion 70 is not necessarily required to be facing rearwardly when the second bogie 18 is attached to the monorail car 16. Instead, the front-joining portion 66 and the rear-joining portion 70 can be positioned in either direction of travel, such that the bogie 18 can move either forwardly or backwardly without changing its orientation on the railway track.

Figure 7:
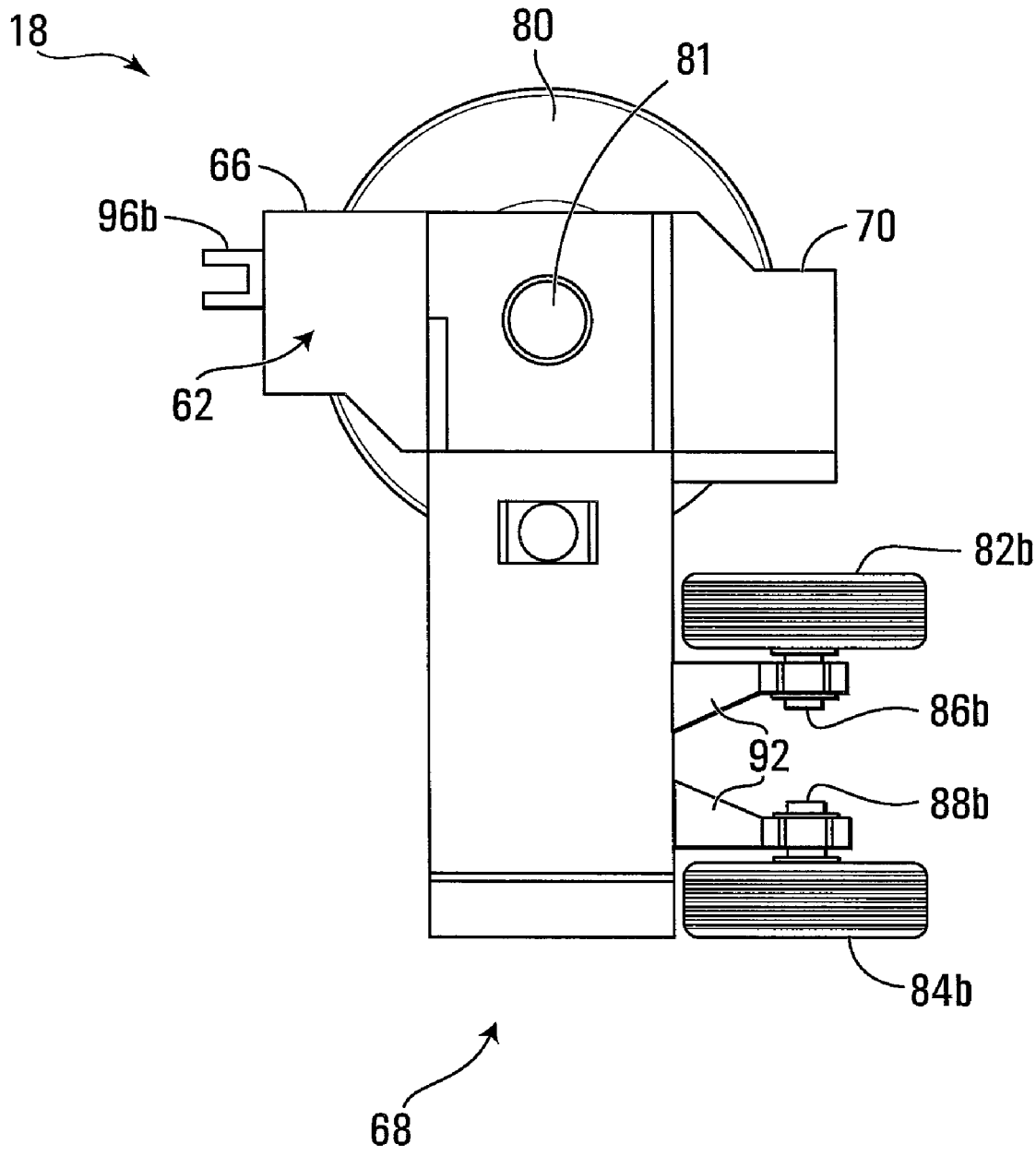
FIG. 7 shows a right side view of the single-axle bogie of FIG. 6.
Figure 8:
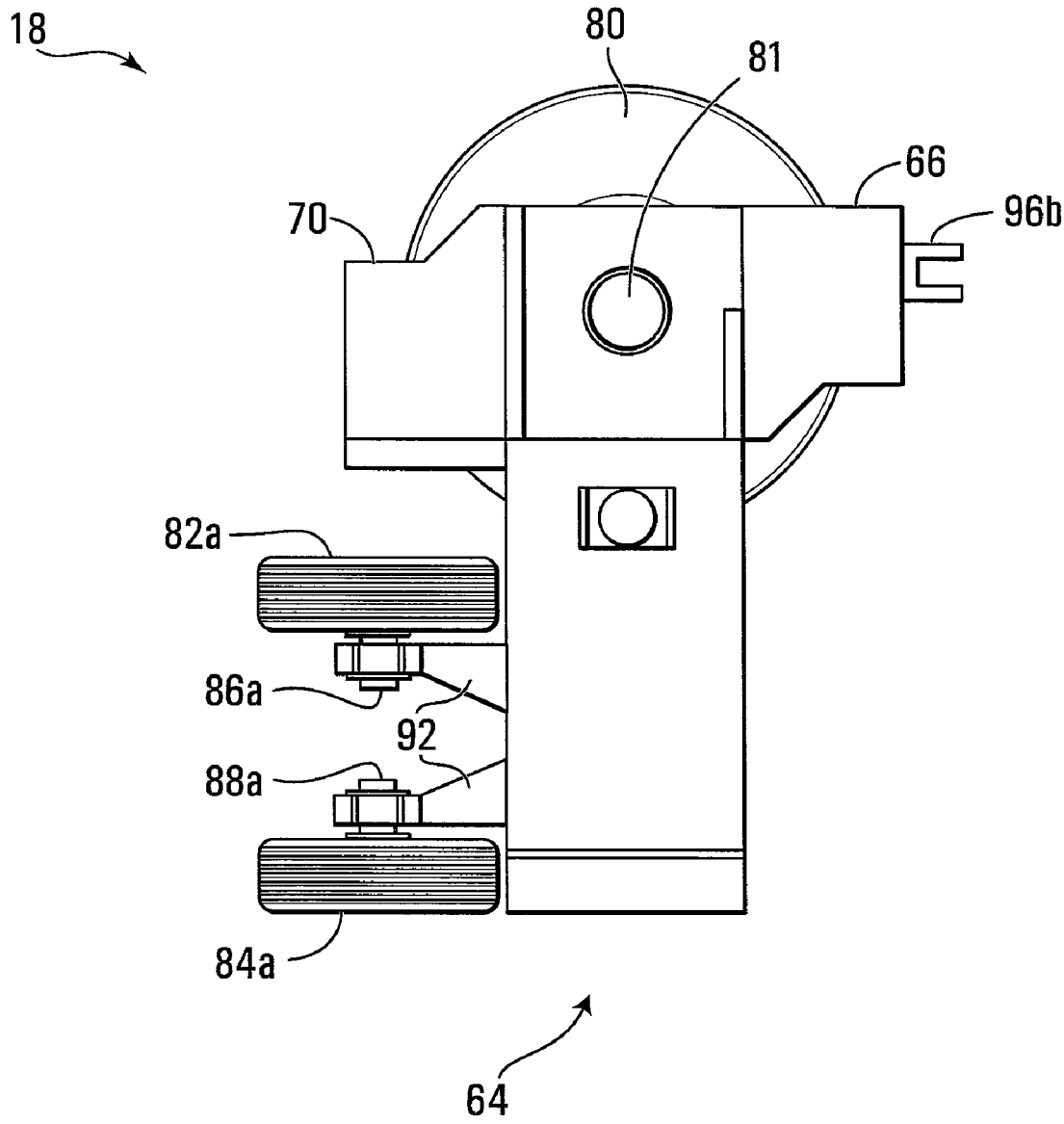
FIG. 8 shows a left side view of the single-axle bogie of FIG. 6.

In the embodiment shown in FIGS. 7 and 8, the body portion 62 of the second bogie 18 is operative for supporting two load bearing wheels 80, two inboard guide wheels 82*a*, 82*b* and two stabilizing wheels 84*a*, 84*b*.

Figure 9:
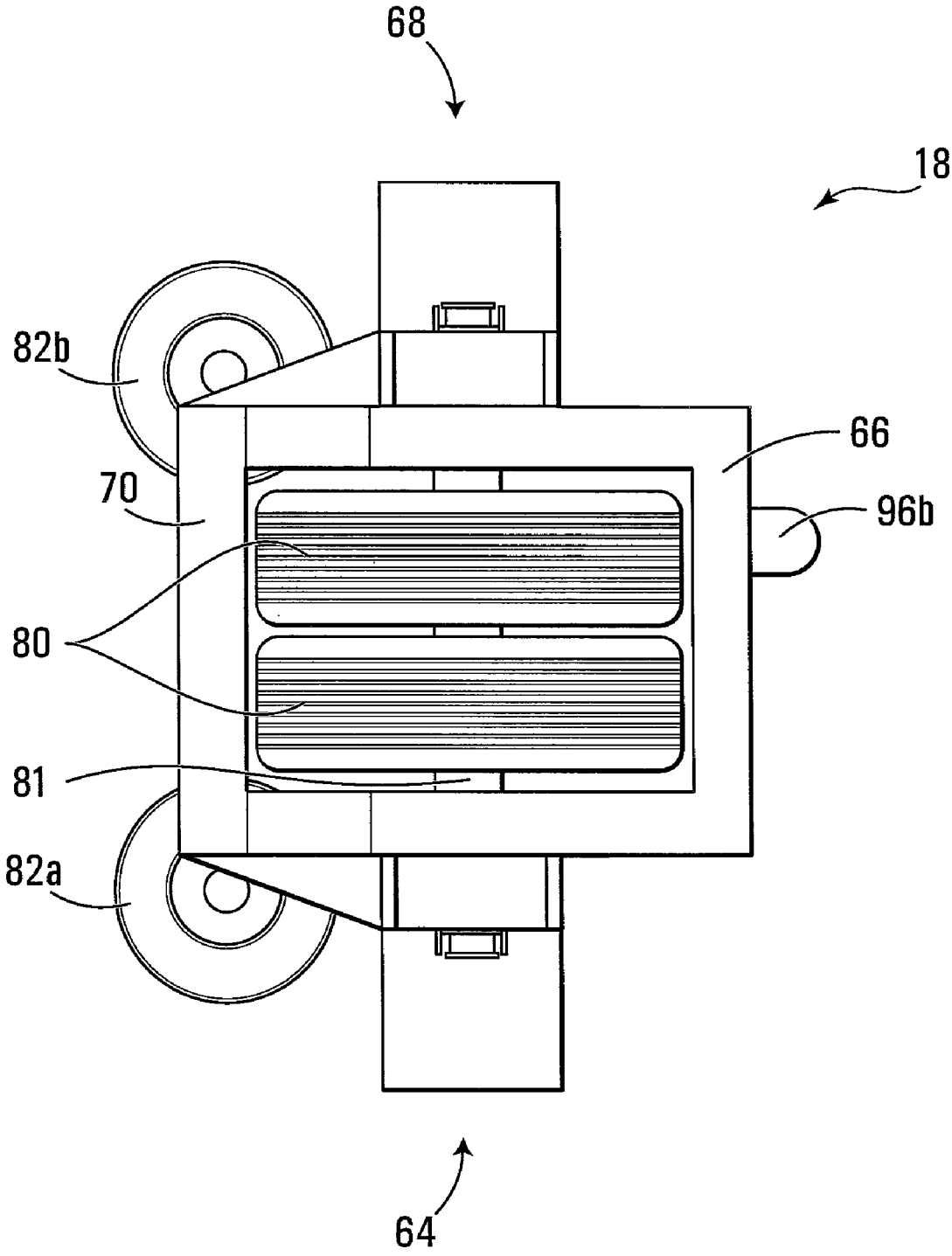
FIG. 9 shows a top view of the single-axle bogie of FIG. 6.

With reference to FIG. 9, it can be seen that the two load-bearing wheels 80 are positioned between the front-joining portion 66 and the rear-joining portion 70. The axle 81 of the two load-bearing wheels 80 is supported on either side by the first side portion 64 and the second side portion 68 of the body portion 62, such that the axis of rotation about which the two load-bearing wheels 80 rotate is parallel to the running surface 22 of the monorail track 20. Although in the embodiment shown, the second bogie 18 includes two load-bearing wheels 80, it should be appreciated that the second bogie 18 could also include only one, or three or more load-bearing wheels 80, without departing from the spirit of the invention. In addition, it should be appreciated that the axle 81 of the load bearing wheels 80 can be supported from only one of side portions 64 or 68 of the body portion 62, or by any other means known in the art.

The axle 81 of the load bearing wheels 80 is positioned perpendicular to the direction of travel of the second bogie 18 and divides the body portion 62 of the second bogie 18 into an inboard side and an outboard side. As used herein, the inboard side of the bogie 18 is the side that is in closer proximity to the centre of the monorail car 16, and the outboard side of the bogie 18 is the side that is in closer proximity to the end of the monorail car 16. The two inboard guide wheels 82*a* and 82*b* are located on the inboard side of the body portion 62 of the second bogie 18 that is in closer proximity to the centre of the monorail car 18. When the second bogie 18 is attached to the monorail car 16, the two inboard guide wheels 82*a* and 82*b* are operative for running along respective ones of the two side surfaces 24 of the monorail track 20. In addition, and as shown in FIGS. 7 and 8, no wheels are located on the outboard side of the body portion 62 that is in closer proximity to the end of the monorail car 16. As such, there are only inboard guide wheels 82*a* and 82*b* on the inboard side of the second bogie 18. The outboard side of the second bogie 18 that is positioned closer to the end of the monorail car 16, is absent any guide wheels.

As shown, the inboard guide wheels 82*a* and 82*b* have axles 86*a* and 86*b*, respectively that have axes of rotation that are laterally offset to the inboard side of the axis of rotation of the load bearing wheels 80. The axles 86*a* and 86*b* are operative for being substantially parallel to the side surfaces 24 of the monorail track 20 when in operation.

As best shown in FIGS. 7 and 8, positioned below both of the inboard guide wheels 82*a*, 82*b* are stabilizing wheels 84*a* and 84*b*. The stabilizing wheels 84*a* and 84*b* have axles 88*a*, 88*b* that are each co-axial with respective axles 86*a*, 86*b* of the inboard guide wheels 82*a*, 82*b*. As indicated above, the stabilizing wheels 84*a* and 84*b* are positioned beneath respective guide wheels. In yet a further embodiment, no stabilizing wheels 84*a* and 84*b* are required and other means of providing roll stability can be used (i.e. by providing dual load wheels spaced sufficiently far apart, etc). The present invention is not limited to the manner in which each bogie achieves roll stabilization.

The inboard guide wheels 82*a*, 82*b* and the stabilizing wheels 84*a*, 84*b* are supported on the second bogie 18 via supporting arms 92. The supporting arms 92 have a flat surface adjacent to the wheel that is being supported, and an angled surface extending from the wheel to the body portion 62 of the second bogie 18. It should be appreciated that in an alternative embodiment, the supporting arms 92 could have a completely different shape, or that the inboard guide wheels 82*a*, 82*b* and the stabilizing wheel 84*a*, 84*b* could be supported in a variety of different manners, other than via supporting arms 92. So long as the inboard guide wheels 82*a*, 82*b* and the stabilizing wheels 84*a*, 84*b* are secured to the second bogie 18 such that their axles 86*a*, 86*b*, 88*a*, 88*b* are substantially parallel to the side surface 24 of the monorail track 20, and such that the axles of the stabilizing wheels 84*a*, 84*b* are positioned directly beneath, and co-axial with, the axles of the inboard guide wheels 82*a*, 82*b*, then the wheels can be mounted to the second bogie 18 in any manner known in the art.

The body portion 26 of the first bogie 14, and the body portion 62 of the second bogie 18 can be made of steel or a steel alloy, among other possibilities. It should be appreciated that the first bogie 14 and the second bogie 18 can be made of a variety of different materials, so long as the material that is used provides the desired strength and rigidity characteristics for the intended application.

The load-bearing wheels 40, 80, guide wheels 42*a*, 42*b*, 44*a*, 44*b*, 82*a*, 82*b* and stabilizing wheels 46*a*, 46*b*, 46*c*, 46*d*, 84*a*, 84*b* are generally made of rubber however, they can also be pneumatic tires, semi-pneumatic tires, solid rubber tires, plastic tires, metal wheels or any other type of tire or wheel known in the art. The load-bearing wheels 40, 80 generally have a diameter of between 6 inches and 1 meter (however, smaller or larger diameter tires or wheels may be used depending on the required application). The guide wheels 42*a*, 42*b*, 44*a*, 44*b*, 82*a*, 82*b* and stabilizing wheels 46*a*, 46*b*, 46*c*, 46*d*, 84*a*, 84*b* also generally have a diameter of between 6 inches and 57 inches (however, smaller or larger diameter tires may be used depending on the required application). It should, however, be appreciated that the dimensions presented above are provided for the purpose of example only, and could vary greatly depending on different constructions and applications of the bogie 14.

In addition, both the first bogie 14 and the second bogie 18 are operative for supporting a suspension system (not shown) for reducing the bumps and shocks experienced by the bogies 14 and 18 from being transferred to the monorail cars 12 and 16.

Figure 2:
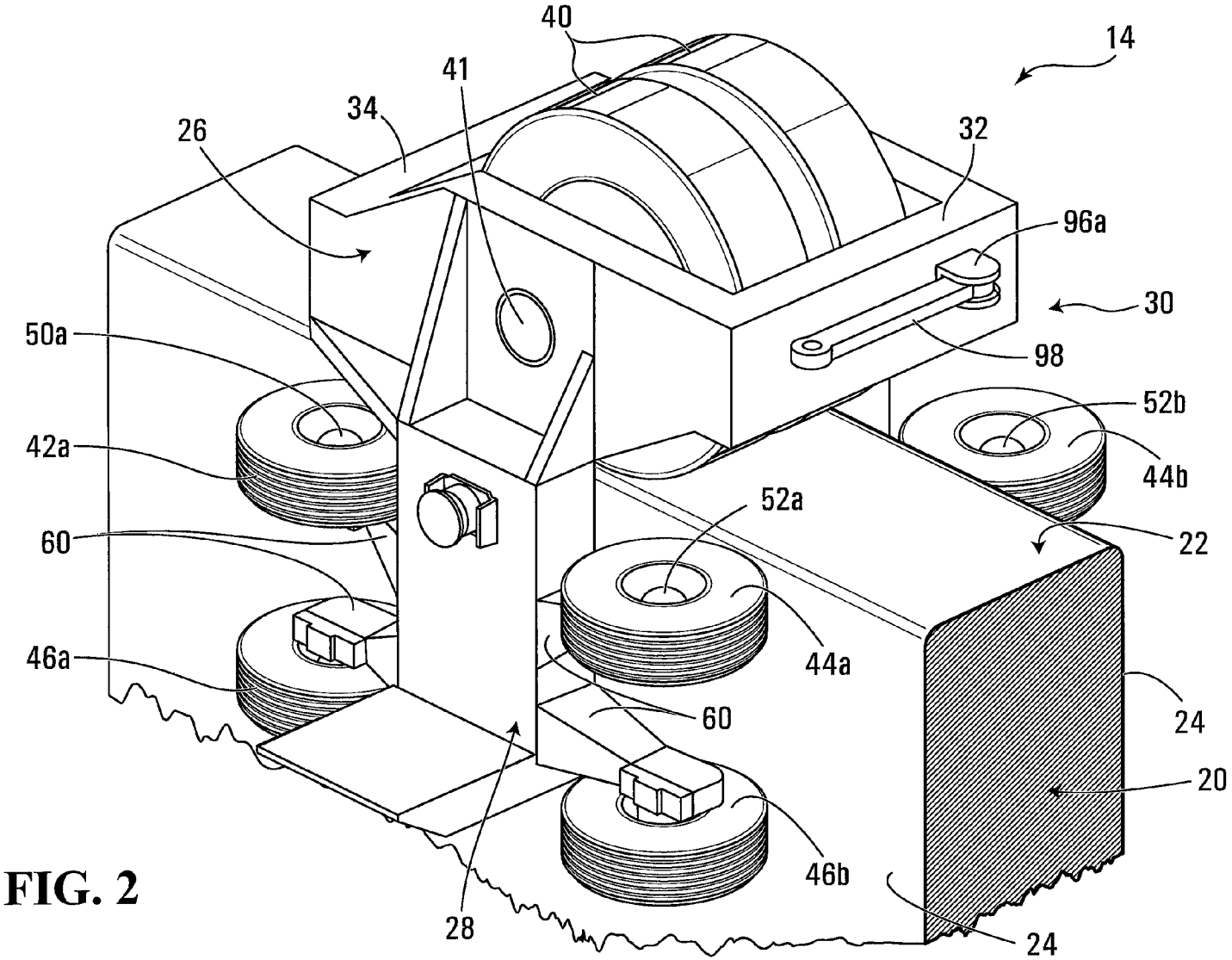
FIG. 2 shows a front perspective view of the first single-axle bogie of FIG. 1.

Referring to FIGS. 2 and 5, located on the front-joining portion 32 of the first bogie 14 is a connection portion 96*a* to which is attached a linking member 98 that is suitable for interconnecting the first bogie 14 and the second bogie 18 together. Shown in FIGS. 10 and 11 are the first and second monorail bogies 14, 18 connected together by the linking member 98.

In accordance with the present invention, the linking member 98 is a rod-shaped member, with one end of the linking member 98 adapted for being pivotally connected to the first monorail bogie 14 at connection portion 96*a* and with the other end of the linking member 98 adapted for being pivotally connected to the second monorail bogie 18 at connection portion 96*b*. In accordance with a non-limiting embodiment, the linking member 98 is fixedly connected at one end to the front joining portion 32 of first bogie 14. More specifically, the linking member 98 is attached to the front joining portion 32 of the first bogie 14 in a permanent manner, such that it cannot be removed therefrom. In addition, the other end of the linking member 98 is adapted for being removably connected to the front-joining portion 66 of the second bogie 18. It should, however, be appreciated that in an alternative embodiment, the linking member 98 can be fixedly connected to the front joining portion 66 of the second bogie 18 and removably connected to the front-joining portion 32 of the first bogie 14. In yet a further embodiment, the linking member 98 can be removably connected to both the front-joining portion 32 of the first bogie 14 and the front-joining portion 66 of the second bogie 18. In this manner, both ends of the linking member 98 are pivotally and removably connected to respective bogies.

The linking member 98 can be removably connected to either of the first and second bogies 14, 18 via a nut and bolt arrangement, via a pin and hole arrangement, or via any other attachment arrangement known in the art, that provides pivotal movement.

Figure 10:
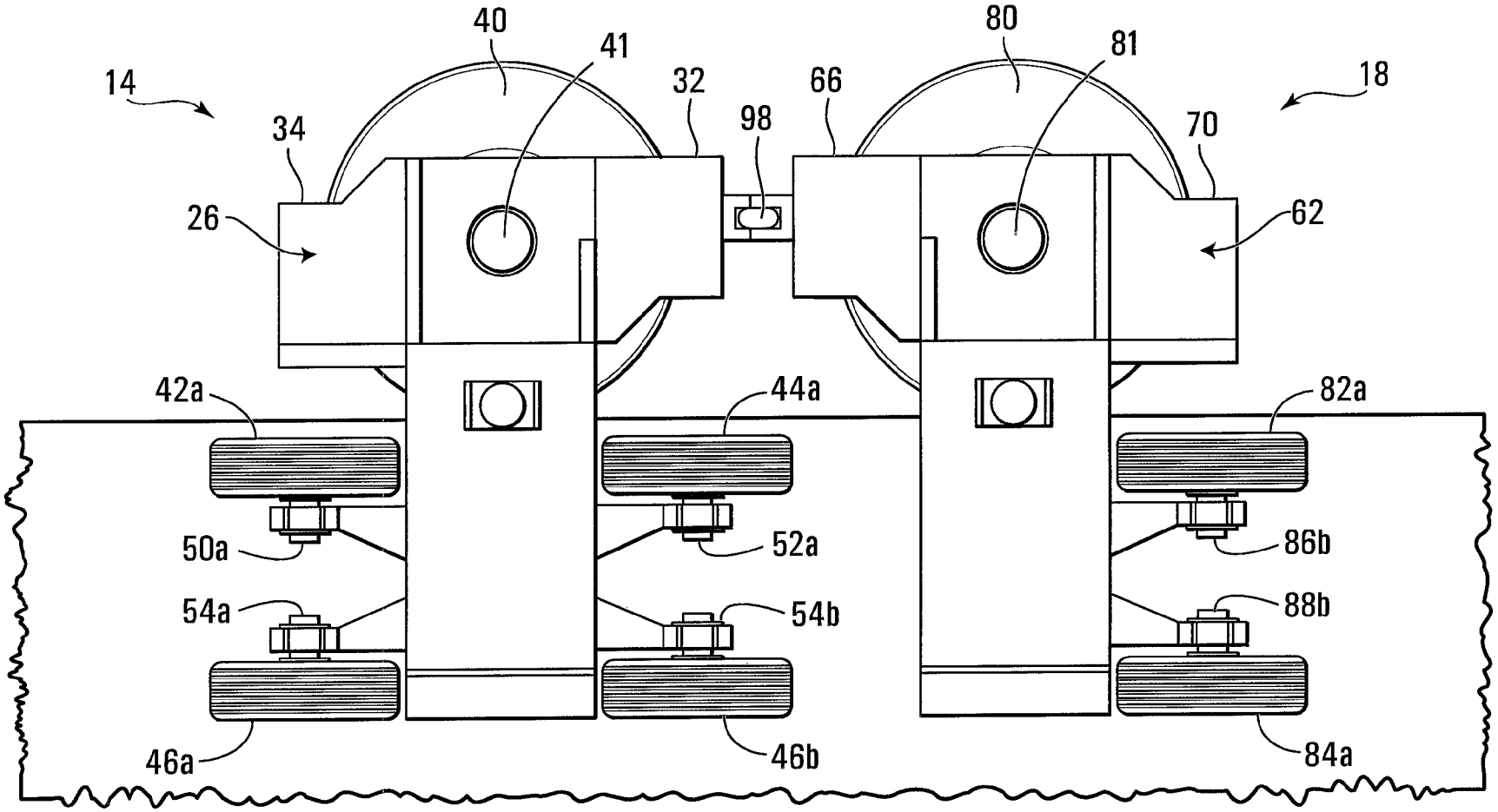
FIG. 10 shows a side view of the first single-axle bogie and the second single-axle bogie of FIG. 1, interconnected together via a linking member.
Figure 11:
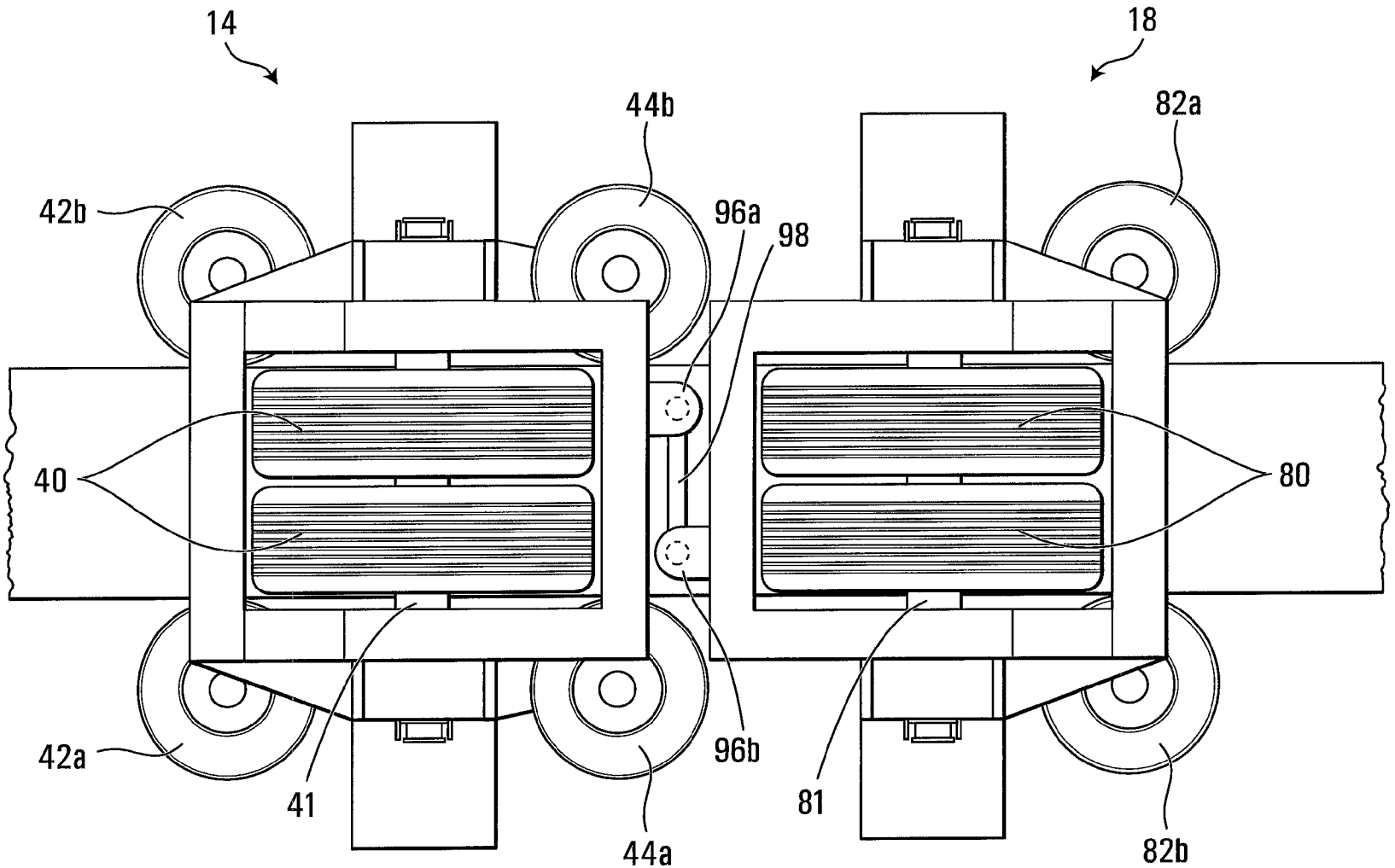
FIG. 11 shows a top plan view of the first single-axle bogie and the second single-axle bogie of FIG. 1, interconnected together on a straight portion of railway track.

As shown in FIG. 10, when the first and second bogies 14, 18 are attached together via the linking member 98, the first and second bogies 14, 18 are positioned relatively close together. In accordance with a non-limiting embodiment, the first and second bogies 14, 18 are sufficiently close together to permit a walk-through space between the first and second monorail cars 12 and 16. In addition, by positioning the first and second bogies 14, 18 relatively close together, the length of the train is reduced, thus saving station and land acquisition costs.

Due to the fact that the bogies 14 and 18 are positioned in close proximity to each other, there is insufficient room for both the bogies 14 and 18 to have outboard guide wheels. Therefore, and as shown, only the first monorail bogie 14 includes outboard guide wheels 44*a*, 44*b*. The outboard guide wheels 44*a*, 44*b* of the first monorail bogie 14 act as the outboard guide wheels for the second bogie 18. This reduces the number of guide wheels required, as well as the wear on the guide-wheels, thus creating cost savings in terms of reduced wheel requirements and maintenance and operating costs. The linking member 98 also balances skewing forces of each independent bogie during curve negotiation so that the load wheels will tend to be more radially aligned, thus minimizing load wheel wear and guide tire forces during curving maneuvers.

As shown in FIGS. 10 and 11, the outboard guide wheels 44*a*, 44*b* of the first bogie 14 extend past the linking member 98 such that a portion of each of the outboard guide wheels 44*a*, 44*b* is positioned beneath the front-joining portion 66 of the second bogie 18. If both the first bogie 14 and the second bogie 18 had outboard guide wheels, the first bogie 14 and the second bogie 18 would not be able to be positioned as close together as they are in the arrangement shown in FIGS. 10 and 11. In addition, by removing the two outboard guide wheels and the stabilizing wheels that would normally be included within the outboard position of the second bogie 18, cost savings are achieved in the form of reduced tire requirements.

The linking member 98 of the present invention permits removal of the outboard guide wheels of the second bogie 18, thus causing the first bogie 14 to act as a master bogie and the second bogie 18 to act as a slave bogie. The master bogie is the bogie that has both inboard and outboard guide wheels, and the slave bogie is the bogie that has only inboard guide wheels. The master bogie (first bogie 14) is in control of steering the slave bogie (second bogie 18) via the linking member 98. The linking member 98 provides good radial steering of both the first bogie 14 and the second bogie 18, within the limited space restrictions.

The outboard wheels 44*a*, 44*b* of the first bogie 14 are able to compensate for relatively small unbalanced steering forces between the first bogie 14 and the second bogie 18 as the interconnected bogies negotiate a curve in the monorail track 20. The natural tendency of each bogie 14, 18 is to steer to the outside of a curve such that the linking member 98 between the two bogies 14, 18 balances the natural steering forces between each bogie, thus substantially unloading the outboard guide wheels 44*a*, 44*b* of the first bogie 14.

Figure 13:
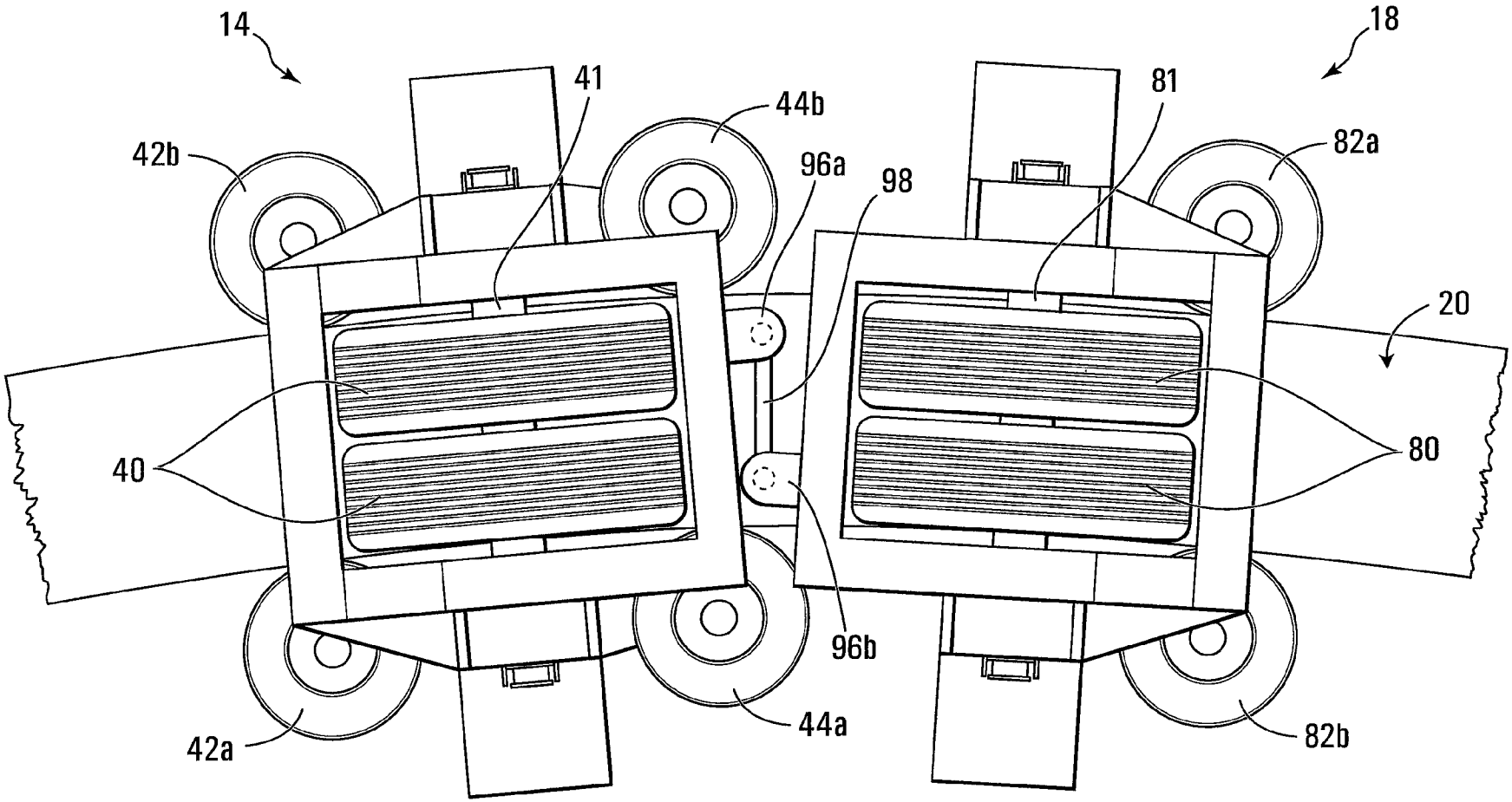
FIG. 13 shows a top plan view of the first single-axle bogie and the second single-axle bogie of FIG. 1, interconnected together on a curved portion of railway track.

As best shown in FIGS. 11 and 13, the linking member 98 has a longitudinal axis, such that when the linking member 98 has connected the first bogie 14 and the second bogie 18 together, the longitudinal axis of the linking member 98 is substantially perpendicular to the direction of travel of the first and second bogies 14, 18. When the first and second bogies 14 and 18 are travelling along a straight section of track, as shown in FIG. 11, the longitudinal axis of the linking member 98 is parallel to the axles 41 and 81 of the load bearing wheels 40 and 80.

However, as shown in FIG. 13, when the first and second bogies 14 and 18 are travelling along a curved section of track 20, the longitudinal axis of the linking member 98 remains aligned with the radius of curvature of the curved section of track. As such, the axle 41 of the load bearing wheels 40, the axle 81 of the load bearing wheels 80 and the longitudinal axis of the linking member 98 are all aligned with the radius of curvature of the track. This reduces the wear and scrubbing of the load wheels and guide wheels as they travel around a curved section of track.

As shown in FIG. 13, as the master bogie 14 travels around the curved section of track 20, it rotates slightly in a counter-clockwise direction, thus causing the pivot point 96*a* between the master bogie 14 and the linking member 98 to move up and to the left. This in turn causes the slave bogie 18 to rotate slightly in a clockwise direction, causing the linking member to pivot at pivot point 96*b*, such that the slave bogie 18 is positioned at an equal and opposite angle in relation to the radius of curvature. This allows the load bearing wheels 40 and 80 to remain in alignment with the radius of curvature of the curved section of track 20.

In the case of a varying radius of curvature, the monorail bogie arrangement that includes the first monorail bogie 14, the second monorail bogie 18 and the linking member is able to align with the median radius of curvature. More specifically, the axle 41, the axle 81 and the longitudinal axis of the linking member 98 are all able to align themselves with a median of the varying radius of curvature between the inboard guide wheels 42*a*, 42*b* of the first monorail bogie 14 and the inboard guide wheels 82*a*, 82*b* of the second monorail bogie 18.

Although in the Figures shown, the linking member 98 is in the form of a lateral rod, in alternative embodiments, the body portions of the master bogie 14 and the slave bogie 18 can be directly connected together via a pin or via a ball and socket arrangement. In such embodiments, the pin or the ball and socket arrangement would be the linking member 98.

When the first and second monorail bogies 14 and 18 are single axle bogies, and are interconnected together via a linking member 98 that is in the form of a rod, as shown in the Figures, each of the monorail bogies 14 and 18 will require a pitching control device (not shown in the Figures) to control the traction forces experienced by the bogies. However, in the case where the linking member 98 is in the form of a pivot pin, or a ball and socket arrangement, then the linking member 98 can absorb traction forces such that a pitching control device is required on only one of the first or second monorail bogies 14 and 18. A linking member 98 in the form of a rod, as shown in the figures, enables the decoupling of any traction forces/movement or relative vertical movement between the first and second bogies 14, 18.

Figure 12:
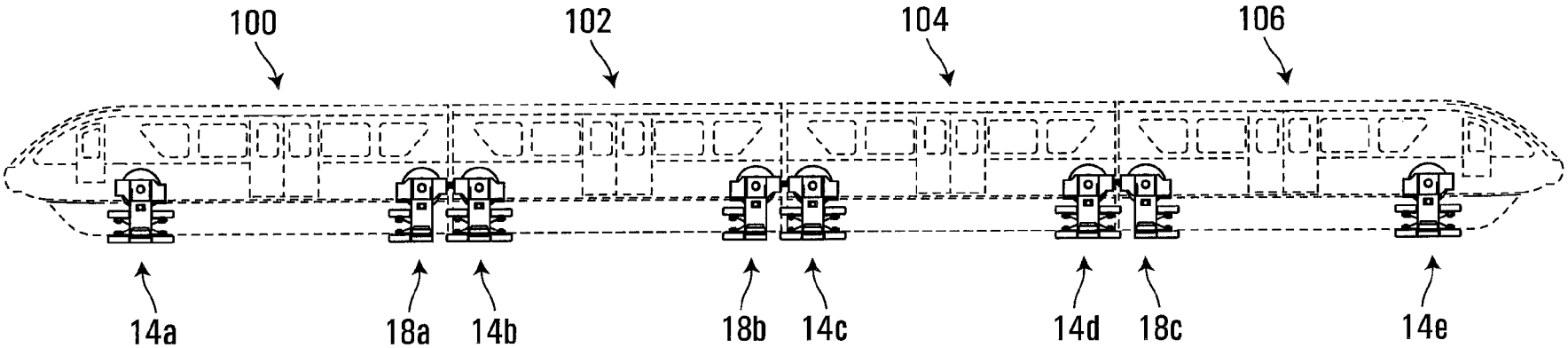
FIG. 12 shows four monorail cars connected together via first and second monorail bogies as shown in FIG. 1.

Shown in FIG. 12 is a non-limiting example of a monorail train that includes four railcars; namely a first nose car 100, a first centre car 102, a second centre car 104 and a second nose car 106. In the embodiment shown, the first nose car 100 includes a master bogie $\mathbf{14}_a$ and a slave bogie $\mathbf{18}_a$. The first centre car 102 includes a master bogie $\mathbf{14}_b$ and a slave bogie $\mathbf{18}_b$. The second centre car 104 includes two master bogies $\mathbf{14}_c$ and $\mathbf{14}_d$. Finally, the second nose car 106 includes a slave bogie 18*c* and a master bogie 14*e*. It should be noted that for each pair of bogies that are connected via a linking member, such as bogies 18*a* and 14*b*, 18*b* and 14*c*, and 14*d* and 18*c*, there is always a master bogie and a slave bogie. As such, any given railcar can have two master bogies, two slave bogies or a mix of a master bogie and a slave bogie. So long as each slave bogie $\mathbf{18}_{a\text{-}c}$ is attached to a corresponding master bogie $\mathbf{14}_{a\text{-}e}$ then the railcar can have any combination of master bogies and slave bogies. Alternative arrangements are evident to those skilled in the art such that other multicar arrangements of bogies are possible as well as single car arrangements such that master and slave bogies could exist inter connected under a single vehicle either as a single pair of bogies for the entire car or alternatively a paired master/slave bogie arrangement at each end of each car, etc.

Figure 14:
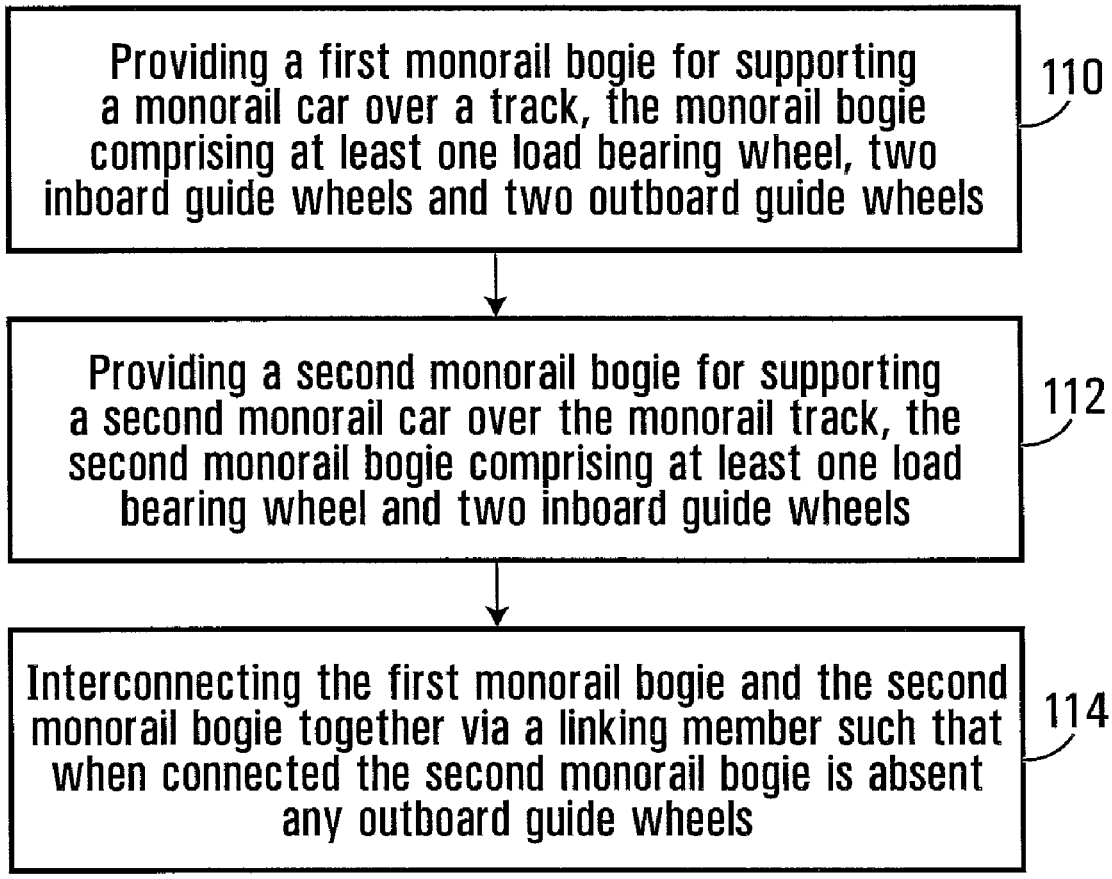
FIG. 14 shows a non-limiting flow diagram of a method of manufacturing a monorail bogie assembly in accordance with an embodiment of the present invention.

An exemplary method of assembling a monorail bogie assembly 10 in accordance with the present invention will be described below with reference to the flow chart in FIG. 14. Firstly, at step 110 the method involves providing a first monorail bogie 14 for supporting a first monorail car 12 over a monorail track 20 that has a running surface 22, and two side surfaces 24. The first monorail bogie 14 comprises at least one load-bearing wheel 40 for running along the running surface 22 of the monorail track, two inboard guide wheels 42*a*, 42*b* for running along respective ones of the two side surfaces of the monorail track 20 and two outboard guide wheels 44*a*, 44*b* for running along respective ones of the two side surfaces 24 of the monorail track 20. The method further comprises providing a second monorail bogie 18 for supporting a second monorail car 16 over the monorail track 20. The second monorail bogie 18 comprises at least one load-bearing wheel 80 for running along the running surface 22 of the monorail track 20 and two inbound guide wheels 82*a*, 82*b* for running along respective ones of the two side surfaces 24 of the monorail track 20. The method further comprises interconnecting the first monorail bogie 14 and the second monorail bogie 18 together via a linking member 98, such that when connected, the second monorail bogie 18 is absent any outboard guide wheels.

An exemplary method of manufacturing a monorail bogie in accordance with the present invention will now be described below. The method comprises providing a body portion 62 of a monorail bogie 18 for supporting a monorail car over a monorail track that has a running surface 22 and two side surfaces 24. The body portion 62 has a longitudinal axis that is parallel to a direction of travel of the monorail bogie 18, and a transverse axis that is perpendicular to the direction of travel of the monorail bogie 18. The body portion 62 is divided into an inboard portion located on a first side of the transverse axis and an outboard portion located on a second side of the transverse axis. The method comprises mounting to the body portion 62 at least one load-bearing wheel 80 for running along the running surface of the monorail track and mounting to the inboard portion of the body portion two guide wheels suitable for running along respective ones of the two side surfaces of the monorail track. The method further comprises mounting to the outboard portion of the body portion a connection portion 96*b* for enabling the body portion to be connected, via a linking member 96, to another monorail bogie 18 that supports a different monorail car, wherein when connected the monorail bogie 18 is absent any outboard guide wheels.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A monorail bogie assembly for supporting monorail cars over a monorail track, the monorail track having a running surface, and two side surfaces, said monorail bogie assembly comprising:

a first monorail bogie for supporting a first monorail car, said first monorail bogie comprising:

i) at least one load-bearing wheel for running along the running surface of the monorail track;

ii) two inboard guide wheels for running along respective ones of the two side surfaces of the monorail track; and iii) two outboard guide wheels, for running along respective ones of the two side surfaces of the monorail track;

a second monorail bogie for supporting a second monorail car, said second monorail bogie comprising:

i) at least one load-bearing wheel for running along the running surface of the monorail track; and ii) two inboard guide wheels for running along respective ones of the two side surfaces of the monorail track;

a linking member for interconnecting said first monorail bogie and said second monorail bogie, such that when connected said second monorail bogie is absent any outboard guide wheels.

2. A monorail bogie assembly as defined in claim 1, wherein said first monorail bogie and said second monorail bogie are single-axle monorail bogies.

3. A monorail bogie assembly as defined in claim 1, wherein said linking member includes a rod that is pivotally connected at a first end to said first monorail bogie and pivotally connected at a second end to said second monorail bogie, said rod comprising a longitudinal axis that is oriented substantially perpendicular to a direction of travel of the first and second monorail cars.

4. A monorail bogie assembly as defined in claim 3, wherein said rod is removably connected to said first monorail bogie and removably connected to said second monorail bogie.

5. A monorail bogie assembly as defined in claim 1, wherein said first monorail bogie comprises at least two stabilizing wheels that are co-axial with respective ones of said two inboard guide wheels, and at least two stabilizing wheels that are co-axial with respective ones of said two outboard guide wheels.

6. A monorail bogie assembly as defined in claim 5, wherein said second monorail bogie comprises a least two stabilizing wheels that are co-axial with respective ones of said two inboard guide wheels.

7. A monorail car assembly for supporting monorail cars over a monorail track, the monorail track having a running surface and two side surfaces, said monorail car assembly comprising:

a first monorail car having a first monorail bogie, the first monorail bogie comprising:

i) at least one load-bearing wheel for running along the running surface of the monorail track;

ii) two inboard guide wheels for running along respective ones of the two side surfaces of the monorail track;

iii) two outboard guide wheels, for running along respective ones of the two side surfaces of the monorail track;

a second monorail car having a second monorail bogie, the second monorail bogie comprising:

i) at least one load-bearing wheel for running along the running surface of the monorail track; and ii) two inbound guide wheels for running along respective ones of the two side surfaces of the monorail track, wherein the second monorail bogie is absent outboard guide wheels;

wherein said first monorail bogie and said second monorail bogie are interconnected via a linking member, wherein said linking member comprises a rod that is pivotally connected at a first end to said first monorail bogie and pivotally connected at a second end to said second monorail bogie, said rod comprising a longitudinal axis that is oriented substantially perpendicular to a direction of travel of the first and second monorail cars.

8. A monorail car assembly as defined in claim 7, wherein said first monorail bogie and said second monorail bogie are single-axle monorail bogies.

9. A monorail car assembly as defined in claim 7, wherein said rod is pivotally connected to said first monorail bogie and removably connected to said second monorail bogie.

10. A monorail car assembly as defined in claim 7, wherein said first monorail bogie comprises at least two stabilizing wheels that are co-axial with respective ones of said two inboard guide wheels, and at least two stabilizing wheels that are co-axial with respective ones of said two outboard guide wheels.

11. A monorail bogie assembly as defined in claim 10, wherein said second monorail bogie comprises a least two stabilizing wheels that are co-axial with respective ones of said two inboard guide wheels.

12. A method for manufacturing a monorail bogie assembly comprising:

providing a first monorail bogie for supporting a first monorail car over a monorail track, the monorail track having a running surface, and two side surfaces, said first monorail bogie comprising:

i) at least one load-bearing wheel for running along the running surface of the monorail track;

ii) two inboard guide wheels for running along respective ones of the two side surfaces of the monorail track; and iii) two outboard guide wheels, for running along respective ones of the two side surfaces of the monorail track;

providing a second monorail bogie for supporting a second monorail car over the monorail track, said second monorail bogie comprising:

i) at least one load-bearing wheel for running along the running surface of the monorail track; and ii) two inbound guide wheels for running along respective ones of the two side surfaces of the monorail track;

interconnecting said first monorail bogie and said second monorail bogie together via a linking member, such that when connected said second monorail bogie is absent any outboard guide wheels.

13. A method as defined in claim 12, wherein said first monorail bogie and said second monorail bogie are single-axle monorail bogies.

14. A method as defined in claim 12, wherein said linking member includes a rod that is pivotally connected at a first end to said first monorail bogie and pivotally connected at a second end to said second monorail bogie, said rod comprising a longitudinal axis that is oriented substantially perpendicular to a direction of travel of the first and second monorail cars.

15. A method as defined in claim 14, wherein said rod is removably connected to said first monorail bogie and removably connected to said second monorail bogie.

16. A method as defined in claim 12, further comprising:

mounting to said first monorail bogie at least two stabilizing wheels that are co-axial with respective ones of said two inboard guide wheels;

mounting to said first monorail bogie at least two stabilizing wheels that are co-axial with respective ones of said two outboard guide wheels; and mounting to said second monorail bogie at least two stabilizing wheels that are co-axial with respective ones of said two inboard guide wheels.

* * * * *